United States Patent [19]

Marusiak, Jr.

[11] 4,449,632

[45] May 22, 1984

[54] TAMPER-PROOF PACKAGE AND METHOD

[76] Inventor: Frank Marusiak, Jr., 73 Ann St., Newark, N.J. 07105

[21] Appl. No.: 449,846

[22] Filed: Dec. 15, 1982

[51] Int. Cl.[3] ..... B65D 85/56; B65D 81/20; B65D 83/04; B65B 25/06

[52] U.S. Cl. ..... 206/540; 206/484; 206/524.8; 206/807

[58] Field of Search ..... 206/484.2, 540, 484, 206/807, 522, 424.8, 205, 497; 229/55

[56] References Cited

U.S. PATENT DOCUMENTS

| | | | |
|---|---|---|---|
| 681,774 | 9/1901 | Bailey . | |
| 1,039,843 | 10/1912 | Syracuse . | |
| 1,452,039 | 4/1923 | Gravell . | |
| 2,034,739 | 3/1936 | Bodor | 215/38 |
| 2,040,798 | 5/1936 | Schoonmaker | 215/37 |
| 2,194,004 | 3/1940 | Bukolt | 215/43 |
| 2,833,398 | 5/1958 | Marshall | 206/46 |
| 2,835,596 | 5/1958 | Kaufman | 99/180 |
| 2,880,900 | 4/1959 | Foye | 215/18 |
| 3,038,593 | 6/1962 | Root et al. | 206/484 |
| 3,152,711 | 10/1964 | Mumford et al. | 215/38 |
| 3,160,302 | 12/1964 | Chaplin | 215/38 |
| 3,443,711 | 5/1969 | Olson | 215/7 |
| 3,574,642 | 4/1971 | Weinke | 206/524.8 |
| 3,736,899 | 6/1973 | Manske | 116/70 |
| 4,150,744 | 4/1979 | Fennimore | 206/205 |
| 4,205,750 | 6/1980 | Dews | 206/497 |

*Primary Examiner*—William T. Dixson, Jr.
*Attorney, Agent, or Firm*—Kenyon & Kenyon

[57] ABSTRACT

A tamper-proof package for articles, such as medicine, is disclosed. The package comprises a first container into which the articles to be protected are placed. A second container made of a substantially gas impermeable material encloses the first container. The space between the first and second containers is filled with a pressurized gas such as air and the second container is sealed. Two elastic layers are tightly stretched about the second container and sealed.

17 Claims, 3 Drawing Figures

TAMPER-PROOF PACKAGE AND METHOD

BACKGROUND OF THE INVENTION

1. Field of the Invention

The present invention relates to tamper-proof packages, and more particularly, to a novel gas-pressurized tamper-proof package and method for packaging for protecting articles such as, for example, drug capsules or tablets and other medicines.

2. Description of the Prior Art

Various tamper-resistant and so-called "tamper-proof" packages and methods are known. Most of the prior art devices cannot be described as truly tamper-proof, although they do offer some form of tamper protection, though not complete. Several patents exist for tamper indicating means which employ either a vacuum or a pressurized member. In addition to tamper-proof devices, other methods for packaging food, for example, are known, in which the object is to give an indication when a vacuum contained within the package has escaped. Other patents deal, more generally, with air-pressurized protective packaging for various objects.

For example, U.S. Pat. No. 2,835,596 discloses a method for packaging marshmallows which uses an air-pressurized bag to provide protective packaging.

U.S. Pat. No. 2,833,398 discloses an inflation cushion sealed container wherein a pressurized bag is placed within the container above the article to be protected in order to provide protective packaging and a tamper-resistant closure for the article. U.S. Pat. No. 2,880,900 uses a similar system employing a vacuum to provide packaging protection.

Other patents, the primary object of which is to determine if a vacuum sealed package has lost its vacuum, include U.S. Pat. Nos. 2,040,798, 3,152,711, 3,160,302, 2,197,004 and 3,736,899. Other pressure or vacuum sensitive closures are disclosed in U.S. Pat. Nos. 3,443,711 and 2,034,739. Typically, all of these patents use a flexible membrane or layer disposed across the top of the sealed container, the shape of which indicates whether the container has lost vacuum. Other patents which disclose tamper resistant seals include U.S. Pat. Nos. 681,774 and 1,039,843.

Generally, the prior art does not fulfill the need for a convenient, economical and fool-proof tamper-proof package for such articles as over-the-counter non-prescription drugs, for example. This is one area in which the need for a tamper-proof container, which readily provides an indication when the container has been tampered with, is evident.

Therefore, it is an object of the present invention to provide a package for articles which is virtually tamper proof.

It is a further object to provide a package for articles which is convenient to use and economical to make and provides a readily visible indication of tampering.

It is a further object of the present invention to provide a package which can be used to protect fragile articles.

SUMMARY OF THE INVENTION

These and other objects of the present invention are achieved by a package for an article which comprises a first container into which the article is placed, a substantially gas impermeable, flexible second container completely enclosing the first container, a void existing between the first and second containers, the void being pressurized with a gas, and a first elastic layer surrounding the second container, the elastic layer tightly stretched about the second container.

In a preferred embodiment, the first elastic layer completely encloses the second container, and the package further comprises a second elastic layer completely enclosing the first elastic layer and tightly stretched about the first elastic layer. Preferably, the second container comprises a hermetically sealed bag made of a polyfoil-polylaminate composite material.

BRIEF DESCRIPTION OF THE DRAWINGS

The present invention will be described in greater detail in the following detailed description with reference to the accompanying drawings in which.

DETAILED DESCRIPTION

Figure 2:
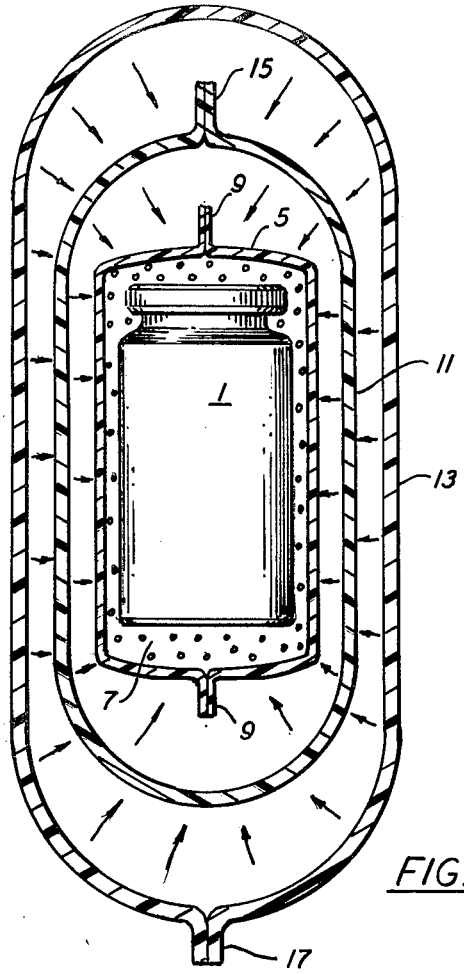
FIG. 2 is a more detailed cross sectional view of the invention shown in FIG. 1.

With reference to the drawings, a conventional bottle or jar of a medicine is shown by reference numeral 1. The bottle is typically made of plastic and may contain, for example, capsules of medicine 3. The bottle 1 is enclosed by a flexible bag 5 which is substantially gas impermeable. A void 7 between the bag 5 and the walls of the bottle 1 is filled with a pressurized gas, such as air, as indicated by the small particles. The bag 5 must be substantially impermeable to the gas so that the pressure within the void 7 is maintained at least for the shelf life of the packaged articles 3, which, in the case of drugs, typically might be several years. The thickness of the walls of bag 5 must be thin to allow convenient opening by legitimate users, however, for example, by the use of scissors. Generally, simple thin rubber or plastic balloons or bags will not be adequate to maintain the pressure within the void 7 for the required period because thin membranes of rubber or plastic are not sufficiently gas or air impermeable. Thus, bag 5 must be made of a sufficiently gas impermeable yet thin material, such as, for example, polyfoil-polylaminate, which is a three-layer composite material having a metallic foil inner layer and outer plastic layers such as polyethylene on either side of the foil. Polyfoil-polylaminate material is commercially available from Reynolds Aluminum, for instance.

The polyfoil-polylaminate bag 5 is sufficiently flexible so that it will be maintained in a distended position when inflated with pressurized gas. Once the bag 5 is pressurized, the ends of the bag are hermetically sealed to maintain sufficient pressure within the bag to keep it in an inflated state. The bag 5 typically is sealed at both ends thereof, as shown by reference numeral 9. Means for sealing, such as hermetic sealing, while at the same time maintaining sufficient pressure in the bag 5, are known.

The sealed bag 5 is then enclosed by an elastic layer 11 which is in tight contact with the bag 5. The elastic layer 11 might comprise, for example, a tightly stretched rubber balloon. The elastic layer 11 is also hermetically sealed as shown by seal 15. In the preferred form of the invention, the elastic layer 11 completely encloses the bag 5. The purposes of the invention can be achieved, although with a somewhat reduced degree of protection, by surrounding the inflated bag 5 with a tightly stretched elastic layer which covers only a limited area of the bag, such as for example, a relatively wide rubber band. As used herein and in the appended claims, the term "surrounding" means that the inner container is completely encircled, although the inner container's outer surface area may not necessarily be completely covered.

Figure 1:
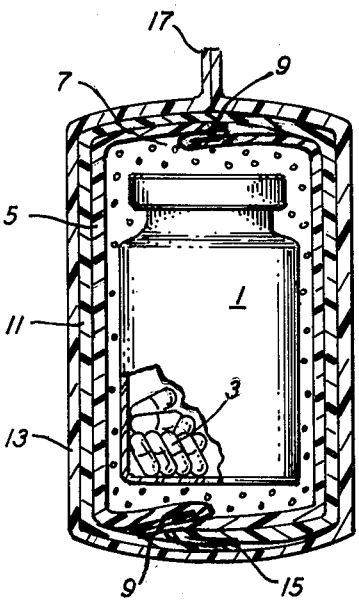
FIG. 1 is a cross sectional view of a preferred embodiment of the present invention.

In the preferred form of the invention, a second elastic layer 13 completely enclosing the first elastic layer is tightly stretched over the first elastic layer 11. The seal 17 of the second elastic layer is made on the end opposite the seal 15 of the first elastic layer. Although one elastic layer is sufficient, two layers provide more protection for several reasons. Should the package be subject to tampering, it will be more difficult to repair two elastic layers, and the use of two layers obviates the possibility of tampering through the hermetic seals 15 or 17 by the placement of the seals in opposite relation to each other. The arrows shown in FIG. 2 illustrate the direction of the forces on the bag 5 due to the tightly stretched elastic skins 11 and 13. The entire package shown in FIGS. 1 and 2 can then be enclosed within a paper carton or other suitable container. Although a primary object of the invention is to provide a tamper-proof package, it is also obvious that the invention provides a convenient protective shipping carton for fragile articles such as medicines.

Figure 3:
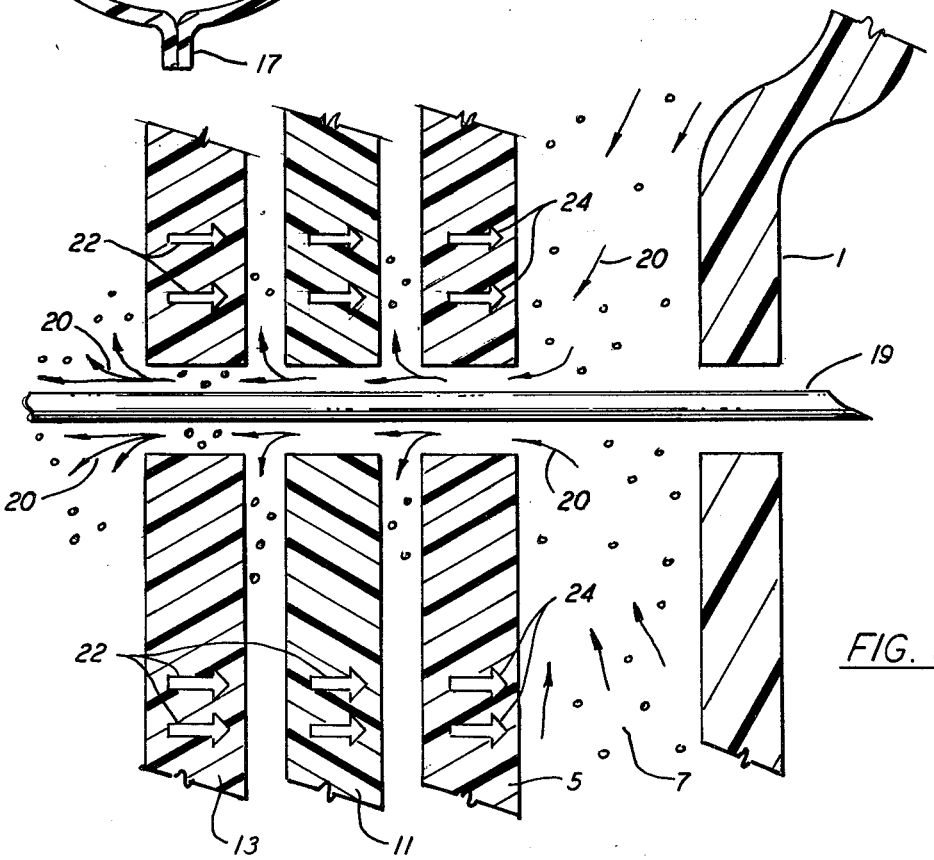
FIG. 3 is a detailed cross sectional view of a portion of the invention shown in FIGS. 1 and 2 which illustrates the reaction of the invention in response to tampering.

FIG. 3 shows a partial cross section, greatly enlarged, of the package ruptured by a piercing apparatus such as a blade or needle 19. As shown, once the elastic layers 13 and 11 and the bag 5 have been punctured, pressurized gas from the void 7 escapes through the rupture as shown by the arrows 20. The forces exerted by the tightly stretched elastic layers 13 and 11, shown by arrows 22, will hasten the collapse of the bag 5, as shown by arrows 24, once the bag is ruptured and the gas escapes. The collapsed condition of the elastic layers 11 and 13 and bag 5 provide a readily visible indication that the package has been subject to tampering. In the case where the elastic layer only covers a limited area of the bag 5, such as for example when relatively wide rubber band is used, the deformed condition of the bag 5 will indicate that tampering has occurred.

The multiple layer construction of the package described in combination with a pressurized gas provides for a virtually tamper-proof packaging device. For example, it will be virtually impossible to repair the bag 5 and elastic layers 11 and 13 without an indication that they have been punctured. Once the gas escapes from bag 5, in most cases the elastic layers 11 and 13 will tear due to the escape of the gas, thus making repair of the layers impossible, and providing a readily visible indication of tampering.

In an alternative embodiment, the package may comprise only the bag 5 inflated by a pressurized gas having the container 1 contained therein. This package would be simpler to make than the preferred embodiment which also includes at least one elastic layer enclosing the bag 5.

In the foregoing specification, the invention has been described with reference to a specific exemplary embodiment thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. A package for an article comprising:
- a first container into which the article is placed;
- a substantially gas impermeable, flexible second container completely enclosing said first container, a void existing between said first and second containers, said void being pressurized with a gas; and
- a first elastic layer surrounding said second container, said elastic layer tightly stretched about said second container.

2. The package recited in claim 1 wherein said first elastic layer completely encloses said second container.

3. The package recited in claim 2, further comprising:
- a second elastic layer completely enclosing said first elastic layer, said second elastic layer tightly stretched about said first elastic layer.

4. The package recited in claim 2 wherein said second container is so substantially gas impervious that the pressure in said void will be substantially maintained for at least the shelf life of the article.

5. The package recited in claim 2 wherein said second container comprises a bag made of polyfoil-polylaminate material.

6. The package recited in claim 2 wherein said gas comprises air.

7. The package recited in claim 3 wherein said first and second elastic layers comprise a rubber or plastic material.

8. The package recited in claim 3 wherein said first and second elastic layers are sealed at respective ends thereof and the seals of said first and second layers are loacted at opposite ends of said package.

9. The package recited in claim 3, further comprising a third container surrounding said elastic layers.

10. A method for packaging an article comprising the steps of:
- completely enclosing a first container containing the article with a flexible gas impermeable second container, a space existing between the first and second containers;
- pressurizing the space between the first and second containers with a gas;
- removing the source of pressurized gas and simultaneously sealing said second container so that a quantity of the pressurized gas is maintained therein; and
- surrounding said second container with a first elastic layer tightly stretched about said second container.

11. The method recited in claim 10, wherein said first elastic layer completely encloses said second container, further comprising the step of sealing said elastic layer.

12. The method recited in claim 11, further comprising the step of completely enclosing said first elastic layer with a second elastic layer tightly stretched about said first elastic layer.

13. A method for tamper-proofing a container for an article comprising the steps of:
- completely enclosing the container containing the article with a flexible gas impermeable second container, a space existing between said containers;
- pressurizing the space between said containers with a gas so as to inflate said second container; and
- sealing said second container so that a quantity of the pressurized gas is maintained therein, said second container thereby being in a normally inflated state, said second container deflating upon puncture to thereby give a visual indication of tampering.

14. The method recited in claim 13 wherein said step of enclosing comprises enclosing said container containing the article with a bag of polyfoil-polylaminate material.

15. A method for packaging an article comprising the steps of:

completely enclosing a first container containing the article with a flexible gas impermeable second container, a space existing between the first and second containers;

pressurizing the space between the first and second containers with a gas;

sealing said second container so that a quantity of the pressurized gas is maintained therein; and surrounding said second container with a first elastic layer tightly stretched about said second container.

16. The method recited in claim 15, wherein said first elastic layer completely encloses said second container, further comprising the step of sealing said elastic layer.

17. The method recited in claim 16, further comprising the step of completely enclosing said first elastic layer with a second elastic layer tightly stretched about said first elastic layer.

* * * * *